US005505902A

United States Patent [19]

Fischer et al.

[11] Patent Number: 5,505,902

[45] Date of Patent: Apr. 9, 1996

[54] METHOD OF MAKING METAL COMPOSITE MATERIALS

[75] Inventors: Udo Fischer, Vällingby; Mats Waldenström, Bromma; Stefan Ederyd, Saltsjö-Boo; Mats Nygren, Bromma; Gunnar Westin, Stockholm; Åsa Ekstrand, Hässelby, all of Sweden

[73] Assignee: Sandvik AB, Sandviken, Sweden

[21] Appl. No.: 412,945

[22] Filed: Mar. 29, 1995

[30] Foreign Application Priority Data

Mar. 29, 1994 [SE] Sweden ..... 9401078-2

[51] Int. Cl.[6] ..... B22F 1/02; B22F 7/00

[52] U.S. Cl. ..... 419/10; 419/14; 419/15; 428/570

[58] Field of Search ..... 419/10, 14, 15; 428/570

[56] References Cited

U.S. PATENT DOCUMENTS

| | | | |
|---|---|---|---|
| 4,498,395 | 2/1985 | Kock et al. | 102/517 |
| 4,770,907 | 9/1988 | Kimura | 427/217 |
| 4,818,567 | 4/1989 | Kemp, Jr. et al. | 427/216 |
| 4,975,333 | 12/1990 | Johnson et al. | 428/570 |
| 5,223,195 | 6/1993 | Kuwabara | 264/60 |
| 5,405,573 | 4/1995 | Clark et al. | 419/35 |

FOREIGN PATENT DOCUMENTS

| | | |
|---|---|---|
| 62-192501 | 8/1987 | Japan . |
| 63-69901 | 3/1988 | Japan . |
| 6-49651 | 2/1994 | Japan . |

*Primary Examiner*—Donald P. Walsh
*Assistant Examiner*—Scott T. Bluni
*Attorney, Agent, or Firm*—Burns, Doane, Swecker & Mathis

[57] ABSTRACT

A method wherein one or more metal salts of at least one iron group metal containing organic groups are dissolved and complex bound in at least one polar solvent with at least one complex former comprising functional groups in the form of OH or $NR_3$, (RH=H or alkyl). Hard constituent powder and, optionally, a soluble carbon source are added to the solution. The solvent is evaporated and the remaining powder is heat treated in an inert and/or reducing atmosphere. As a result, coated hard constituent powder is obtained which after addition of a pressing agent can be compacted and sintered according to standard practice to a body containing hard constituents in a binder phase.

16 Claims, 2 Drawing Sheets

METHOD OF MAKING METAL COMPOSITE MATERIALS

BACKGROUND OF THE INVENTION

The present invention relates to a method of producing metal composite materials such as cemented carbide.

Cemented carbide and titanium-based carbonitride alloys often referred to as cermets consist of hard constituents based on carbides, nitrides and/or carbonitrides of Ti, Zr, Hf, V, Nb, Ta, Cr, Mo and/or W in a binder phase essentially based on Co and/or Ni. They are made by powder metallurgical methods of milling a powder mixture containing powder forming the hard constituents and binder phase, pressing and sintering.

The milling operation is an intensive milling in mills of different sizes and with the aid of milling bodies. The milling time is on the order of several hours to several days. Such processing is believed to be necessary in order to obtain a uniform distribution of the binder phase in the milled mixture. It is further believed that the intensive milling creates a reactivity of the mixture which further promotes the formation of a dense structure.

British Patent No. 346,473 discloses a method of making cemented carbide bodies. Instead of milling, the hard constituent grains are coated with binder phase with an electrolytic method, pressed and sintered to a dense structure. This and other similar methods are, however, not suited for cemented carbide production in a large industrial scale and milling is almost exclusively used within the cemented carbide industry today. However, milling has its disadvantages. During the long milling time the milling bodies are worn and contaminate the milled mixture which has to be compensated for. The milling bodies can also break during milling and remain in the structure of the sintered bodies. Furthermore even after an extended milling a random rather than an ideal homogeneous mixture may be obtained. In order to ensure an even distribution of the binder phase in the sintered structure sintering has to be performed at a higher temperature than necessary.

The properties of the sintered metal composite materials containing two or more components depend to a great extent on how well the starting materials are mixed. An ideal mixture of particles of two or more kinds especially if one of the components occurs as a minor constituent (which is the case for the binder phase in ordinary metal composite materials) is difficult to obtain. In practice, after extended mixing a random rather than an ideal homogeneous mixture is obtained. In order to obtain an ordered mixing of the components in the latter case, the minor component can be introduced as a coating. The coating can be achieved by the use of various chemical techniques. In general it is required that some type of interaction between the coated component and the coating is present, i.e., adsorption, chemisorption, surface tension or any type of adhesion.

SUMMARY OF THE INVENTION

It is an object of this invention to avoid or alleviate the problems of the prior art.

The invention provides a method of making a hard constituent powder coated with at least one iron group metal. The method includes forming a solution by dissolving and complex binding at least one salt of at least one iron group metal containing organic groups in at least one polar solvent with at least one complex former comprising functional groups in the form of OH or $NR_3$ wherein R=H or alkyl. The method further includes adding hard constituent powder to the solution, forming a powder mixture by evaporating the solvent, and forming a metal coating on the hard constituent powder by heat treating the powder mixture in an inert and/or reducing atmosphere until the hard constituent powder is coated with at least one iron group metal.

The method can further include adding a soluble carbon source to the solution. The salt can comprise a carboxylate, acetylacetonate and/or acetate. The solvent can comprise methanol, triethanolamine, dimethylformamide and/or dimethylsulfoxide. The solvent can comprise a mixture such as methanol and ethanol or water and glycol. The soluble carbon source can comprise sugar and carbon can be included in the metal coating.

The method can further comprise a step of adding a pressing agent to the metal coated powder. The metal coated powder can be pressed into a shaped body and the shaped body can be sintered. During the metal coating step, the inert and/or reducing atmosphere can be nitrogen, hydrogen, argon, ammonia, carbon monoxide and/or carbon dioxide. Prior to forming a sintered body, the metal coated powder can be mixed with additional coated hard constituent powder, binder phase metal, carbon and/or uncoated hard constituent powder. During the step of forming the solution, the solution can be heated and/or stirred.

Carbon can be incorporated in the metal coating during the step of forming the metal coating. The hard constituent powder can comprise WC, (Ti,W)C, (Ta,Nb)C, (Ti,Ta,Nb)C, (Ti,W), (C,N), TiC, TaG, NbC, VC and/or $Cr_3C_2$. The method can further comprise kneading the powder mixture prior to the step of forming the metal coating. In addition, the powder can be heated to 400° to 1100° C. during the step of forming the metal coating.

DETAILED DESCRIPTION OF THE PREFERRED EMBODIMENTS

Figure 1:
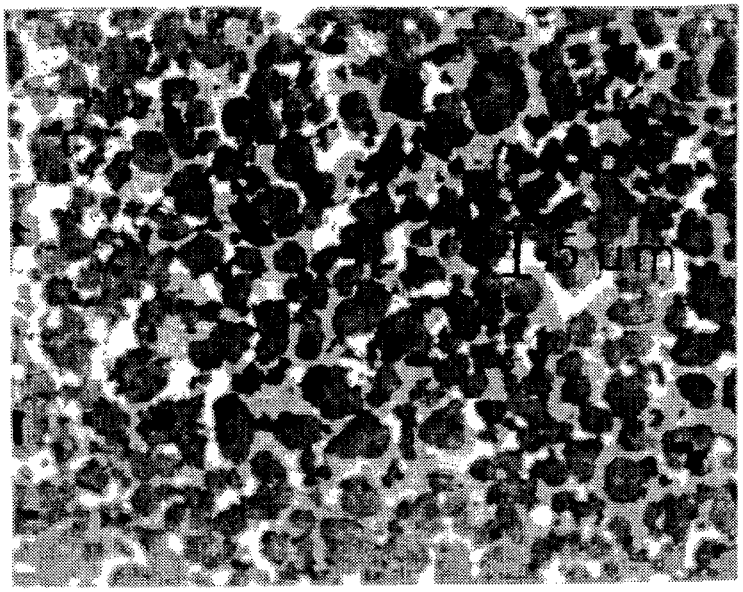
FIGS. 1–3 show 1000X enlargements of the microstructure of cemented carbide compositions made with the method of the present invention.

According to the method of the present invention it has now surprisingly been found that using a technique related to the SOL-GEL technique the hard constituent grains, cubic as well as hexagonal, can be coated with binder phase layers. The coating process seems not to pass a gel state and therefore is not a strict SOL-GEL process but should rather be regarded as a "solution-chemical method". In this process, one or more metal salts of at least one iron group metal containing organic groups are dissolved and complex bound in at least one polar solvent with at least one complex former comprising functional groups in the form of OH or $NR_3$, (R=H or alkyl). Hard constituent powder and optionally a soluble carbon source are added to the solution. The solvent is evaporated and remaining powder is heat treated in an inert and/or reducing atmosphere. As a result, coated hard constituent powder is obtained which after addition of a pressing agent can be compacted and sintered in a conventional manner.

The process according to the invention comprises the following steps where Me=Co, Ni and/or Fe, preferably Co:

Step 1. At least one Me-salt containing organic group such as carboxylates, acetylacetonates, nitrogen containing organic groups such as schiff bases, preferably Me-acetates, is dissolved in at least one polar solvent such as ethanol, acetonitrile, dimethylformamide or dimethylsulfoxide and combinations of solvents such as methanol-ethanol and water-glycol, preferably methanol. Triethanolamine or other complex former especially molecules containing more than two functional groups, i.e., OH or $NR_3$ with R=H or alkyl (0.1–2.0 mole complex former/mole metal, preferably about 0.5 mole complex former/mole metal) is added under stirring.

Step 2. Optionally, sugar ($C_{12}H_{22}O_{11}$) or other soluble carbon source such as other types of carbohydrates and/or organic compounds which decompose under formation of carbon in the temperature interval 100°–500° C. in a non-oxidizing atmosphere can be added (<2.0 mole C/mole metal, preferably about 0.5 mole C/mole metal), and the solution heated to 40° C. in order to improve the solubility of the carbon source. The carbon is used to reduce the MeO formed in connection with heat treatment and to regulate the C-content in the coating layer.

Step 3. Hard constituent powder such as WC, (Ti,W)C, (Ta,Nb)C, (Ti,Ta,Nb)C, (Ti,W)(C,N), TiC, TaC, NbC, VC and $Cr_3C_2$, preferably well-deagglomerated, e.g., by jet milling, is added under moderate stirring and the temperature is increased to accelerate the evaporation of the solvent. When the mixture has become rather viscous, the dough-like mixture is kneaded and when almost dry smoothly crushed in order to facilitate the evaporation (avoiding inclusions of solvent).

Step 4. The loosened powder lump obtained in the preceding step is heat treated in nitrogen and/or hydrogen at about 400°–1100° C., preferably 500°–900° C. To achieve a fully reduced powder a holding temperature might be needed. The time of heat treatment is influenced by process factors such as powder bed thickness, batch size, gas composition and heat treatment temperature and has to be determined by experiments. A holding time for reduction of a 5 kg powder batch in a pure hydrogen atmosphere at 700° C. of 120–180 minutes has been found suitable. Nitrogen and/or hydrogen is normally used but Ar, $NH_3$, CO and $CO_2$ (or mixtures thereof) can be used whereby the composition and microstructure of the coating can be modulated.

Step 5. After the heat treatment the coated powder is mixed with a pressing agent in ethanol to form a slurry either alone or with other coated hard constituent powders and/or uncoated hard constituent powders and/or binder phase metals and/or carbon to obtain the desired composition. The slurry then is dried, compacted and sintered in the usual way to obtain a sintered body of hard constituents in a binder phase.

Most of the solvent can be recovered which is of great importance when scaling up to industrial production.

Alternatively, the pressing agent can be added together with the hard constituent powder according to step 3, directly dried, pressed and sintered.

The following examples are given to illustrate various aspects of the invention.

EXAMPLE 1

A WC-6% Co cemented carbide was made in the following way according to the invention: 134.89 g cobalacetatetetrahydrate ($CO(C_2H_3O_2)_2.4H_2O$) was dissolved in 800 ml methanol ($CH_3OH$). To this solution, 36.1 ml triethanolamine ($(C_2H_5O)_3N$ (0.5 mole TEA/mole Co) was added during stirring and after that 7.724 sugar (0.5 mole C/mole Co) was added. The solution was heated to about 40° C. in order to dissolve all the sugar added. After that 500 g of jetmilled WC powder was added and the temperature was increased to about 70° C. Careful stirring took place continuously during the time the methanol was evaporating until the mixture had become viscous. The dough-like mixture was worked and crushed with a light pressure when it had become almost dry.

The powder obtained was fired in a furnace in a porous bed about 1 cm thick in a nitrogen atmosphere in a closed vessel, heating rate 10° C./min. to 700° C., no holding temperature, cooling 10° C./min. and finally completed with reduction in hydrogen, holding temperature 800° C. for 90 minutes.

Figure 2:
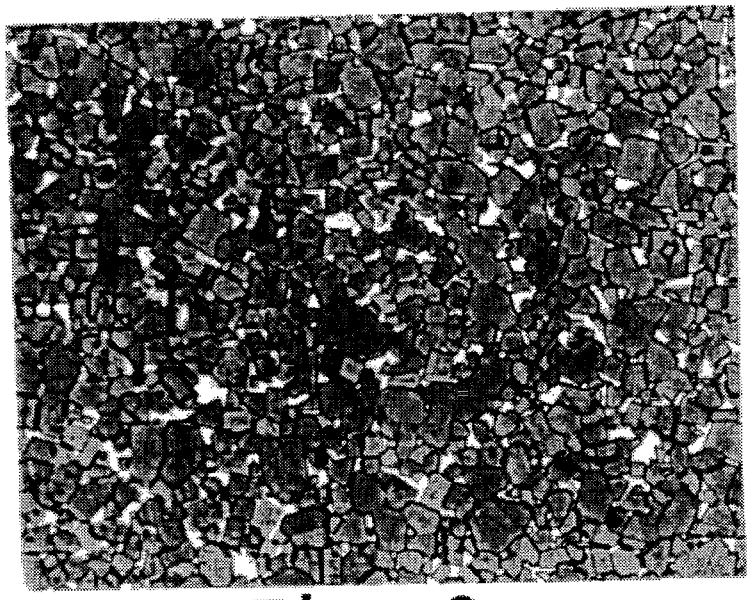

The powder obtained was mixed with a pressing agent in ethanol with no adjustment of carbon content, dried, compacted and sintered according to standard practice for WC-Co alloys. A dense cemented carbide structure was obtained with porosity A00. FIG. 1 shows the microstructure at 1000X of a compacted body before sintering and FIG. 2 shows the microstructure at 100 0X after sintering.

EXAMPLE 2

A (Ti,W)C-11% Co powder mixture was made in the following way according to the invention: 104.49 g cobaltacetatetetrahydrate ($Co(C_2H_3O_2)_2.4H_2O$) was dissolved in 630 ml methanol ($CH_3OH$). To this solution, 28 ml triethanolamine ($(C_2H_5O)_3N$ (0.5 mole TEA/mole Co) was added during stirring and after that 5.983 g sugar (0.5 mole C/mole Co) was added. The solution was heated to about 40° C. in order to dissolve all the sugar added. Subsequently 200 g of jet-milled (Ti,W)C powder was added and the temperature was increased to about 70° C. Careful stirring took place continuously during the time the methanol was evaporating until the mixture had become viscous. The dough-like mixture was worked and crushed with a light pressure when it had become almost dry. The powder obtained was fired in a furnace in a porous bed about 1 cm thick in nitrogen atmosphere in a closed vessel, heating rate 10° C./min. to 700° C., no holding temperature, cooling 10° C./min. and finally completed with reduction in hydrogen, holding temperature 800° C. for 90 minutes.

Figure 3:
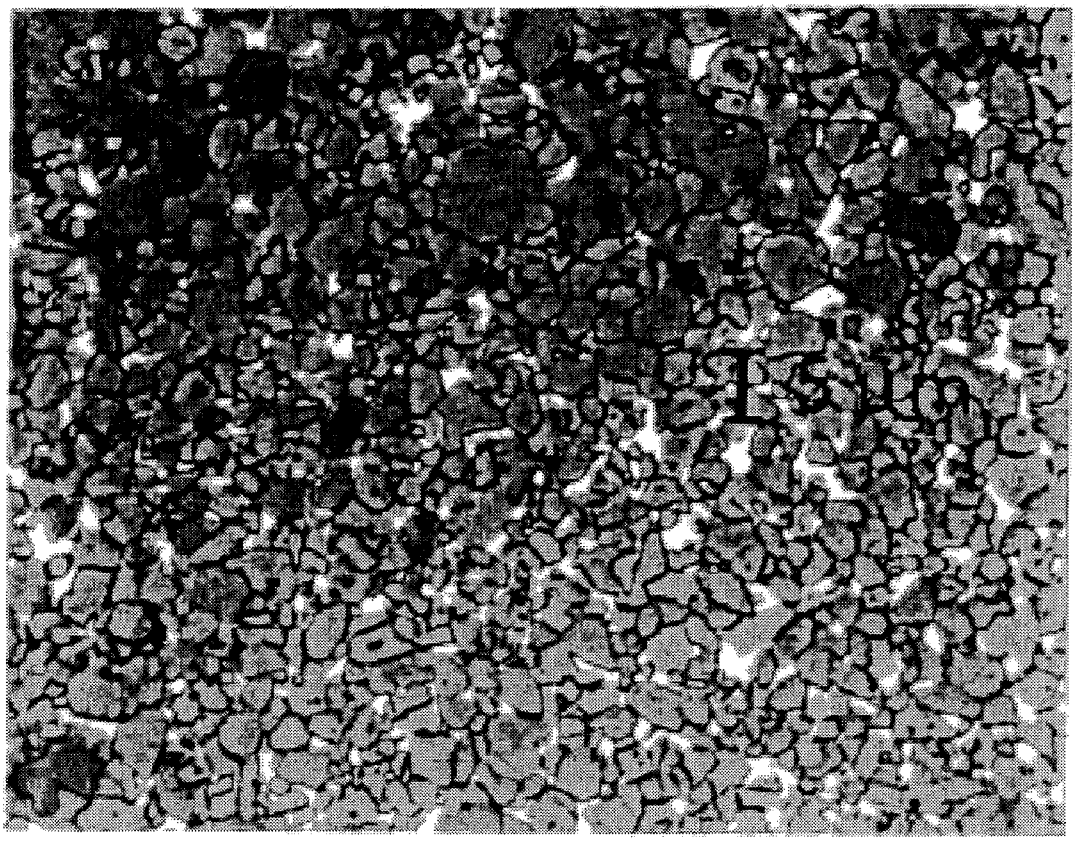

The powder obtained was mixed with the WC-Co powder from example 1 and a pressing agent in ethanol with no adjustment of carbon content, dried, compacted and sintered according to standard practice. A dense WC-(Ti,W)C-7% Co-cemented carbide structure was obtained with porosity A02 (See FIG. 3).

EXAMPLE 3

A WC-6% Co cemented carbide was made according to Example 1 but with a modified combined heat treatment cycle set forth below:

The powder was fired in a nitrogen atmosphere in a closed vessel, heating rate 10° C./min. to 500° C. completed with reduction in hydrogen for 180 minutes, finally followed by cooling in a nitrogen atmosphere at 10° C./min. In contrast to Example 1, no cooling step between burning off and reduction step was used.

The powder obtained was mixed with a pressing agent in ethanol with no adjustment of carbon content, dried, compacted and sintered according to standard practice for WC-Co alloys. A dense cemented carbide structure was obtained with porosity A00.

EXAMPLE 4

A WC-6% Co cemented carbide was made according to Example 1 but with no sugar added to the solution and a modified combined heat treatment cycle set forth below:

The powder was fired in a nitrogen atmosphere in a closed vessel, heating rate 10° C./min to 600° C. completed with reduction in hydrogen for 180 minutes, finally followed by cooling in a nitrogen atmosphere at 10° C./min. In contrast to Example 1, no cooling step between the burning off and reduction step was used.

The powder obtained was mixed with a pressing agent in ethanol with adjustment of carbon content according to standard practice, dried, compacted and sintered according to standard practice for WC-Co alloys. A dense cemented carbide structure was obtained with porosity A00.

EXAMPLE 5

A WC-6% Co cemented carbide was made according to Example 1 but with a modified combined heat treatment cycle set forth below:

The powder was fired in a nitrogen/hydrogen atmosphere (75% $N_2$/25% $H_2$) in a closed vessel, heating rate 10° C./min to 700° C. completed with reduction in the same nitrogen/hydrogen atmosphere (75% $N_2$/25% $H_2$) for 180 minutes, finally followed by cooling in nitrogen/hydrogen (75% $N_2$/25% $H_2$) at 10° C./min. In contrast to Example 1, no cooling step between the burning off and reduction step was used.

The powder obtained was mixed with a pressing agent in ethanol with no adjustment of carbon content, dried, compacted and sintered according to standard practice for WC-Co alloys. A dense cemented carbide structure was obtained with porosity A00.

EXAMPLE 6

A WC-6% Co cemented carbide was made according to Example 1 but with no sugar added to the solution and a modified combined heat treatment cycle set forth below:

The powder was fired in a nitrogen atmosphere in a closed vessel, heating rate 10° C./min to 700° C. completed with reduction in hydrogen for 180 minutes, finally followed by cooling in a nitrogen atmosphere at 10° C./min. In contrast to Example 1, no cooling step between the burning off and reduction step was used.

The powder obtained was mixed with a pressing agent in ethanol with adjustment of carbon content according to standard practice, dried, compacted and sintered according to standard practice for WC-Co alloys. A dense cemented carbide structure was obtained with porosity A00.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method of making a hard constituent powder coated with at least one iron group metal, comprising the following steps:

forming a solution by dissolving and complex binding at least one salt of at least one iron group metal containing organic groups in at least one polar solvent with at least one complex former comprising functional groups in the form of OH or $NR_3$, wherein R=H or alkyl;

adding hard constituent powder to the solution;

forming a powder mixture by evaporating the solvent;

forming a metal coating on the hard constituent powder by heat treating the powder mixture in an atmosphere until the hard constituent powder is coated with at least one iron group metal, said atmosphere being selected from the group consisting of inert atmospheres, reducing atmospheres, and mixtures thereof.

2. The method of claim 1, further comprising adding a soluble carbon source to the solution.

3. The method of claim 1, wherein the salt is selected from the group consisting of carboxylates, acetylacetonates, acetates, and mixtures thereof.

4. The method of claim 1, wherein the solvent is selected from the group consisting of methanol, triethanolamine, dimethylformamide, dimethylsulfoxide, and mixtures thereof.

5. The method of claim 1, wherein the solvent comprises a mixture of methanol and ethanol, or water and glycol.

6. The method of claim 1, wherein sugar is added to the solution.

7. The method of claim 1, wherein carbon is included in the metal coating.

8. The method of claim 1, wherein the metal coated powder is pressed into a shaped body and the shaped body is sintered.

9. The method of claim 1, wherein the atmosphere is selected from the group consisting of nitrogen, hydrogen, argon, ammonia, carbon monoxide, carbon dioxide, and mixtures thereof.

10. The method of claim 1, wherein the metal coated powder is mixed with one or more of coated hard constituent powder, binder phase metal, carbon and uncoated hard constituent powder to form a metal coated powder mixture, said powder mixture being further compacted and sintered.

11. The method of claim 1, wherein the solution is heated prior to adding said hard constituent powder.

12. The method of claim 1, wherein the solution is stirred prior to adding said hard constituent powder.

13. The method of claim 1, wherein carbon is incorporated in the metal coating during the step of forming the metal coating.

14. The method of claim 1, wherein the hard constituent powder comprises WC, (Ti,W)C, (Ta,Nb)C, (Ti,Ta,Nb)C, (Ti,W)C, TiC, TaC, NbC, VC, $Cr_3C_2$, and mixtures thereof.

15. The method of claim 1, further comprising kneading the powder mixture prior to the step of forming the metal coating.

16. The method of claim 1, wherein the powder is heated to 400° to 1100° C. during the step of forming the metal coating.

* * * * *